US011789408B2

(12) United States Patent
Jacquot et al.

(10) Patent No.: US 11,789,408 B2
(45) Date of Patent: Oct. 17, 2023

(54) SPRING RING FOR SNAP FITTING A ROTATING BEZEL

(71) Applicant: Comadur S.A., Le Locle (CH)

(72) Inventors: Emmanuel Jacquot, Grand'Combe-Châteleu (FR); Laurent Bourcet, Belfays (FR)

(73) Assignee: Comadur S.A., Le Locle (CH)

( * ) Notice: Subject to any disclaimer, the term of this patent is extended or adjusted under 35 U.S.C. 154(b) by 274 days.

(21) Appl. No.: 17/022,373

(22) Filed: Sep. 16, 2020

(65) Prior Publication Data

US 2021/0103252 A1 Apr. 8, 2021

(30) Foreign Application Priority Data

Oct. 4, 2019 (EP) ..... 19201389

(51) Int. Cl.
*G04B 19/28* (2006.01)

(52) U.S. Cl.
CPC ..... *G04B 19/283* (2013.01)

(58) Field of Classification Search
CPC ..... G04B 19/28; G04B 19/283; G04B 19/223
See application file for complete search history.

(56) References Cited

U.S. PATENT DOCUMENTS

| | | | | |
|---|---|---|---|---|
| 5,822,279 | A * | 10/1998 | Cuche | G04B 19/286 368/295 |
| 11,243,496 | B2 * | 2/2022 | Silvant | G04B 19/283 |
| 11,262,703 | B2 * | 3/2022 | Silvant | G04B 19/283 |
| 11,385,597 | B2 * | 7/2022 | Silvant | G04B 19/286 |
| 2014/0098650 | A1 | 4/2014 | Antille | |
| 2018/0032034 | A1 | 2/2018 | Vuille et al. | |
| 2019/0187619 | A1 * | 6/2019 | Wahler | G04B 37/0041 |
| 2019/0294113 | A1 * | 9/2019 | Silvant | G04B 19/283 |
| 2019/0294114 | A1 * | 9/2019 | Silvant | G04B 19/286 |
| 2019/0294115 | A1 | 9/2019 | Silvant | |

FOREIGN PATENT DOCUMENTS

| | | | |
|---|---|---|---|
| DE | 3205821 | C1 | 7/1983 |
| EP | 0 436 468 | A1 | 7/1991 |
| EP | 3 543 799 | A1 | 9/2019 |
| JP | 54-92357 | A | 7/1979 |
| JP | 2018-17731 | A | 2/2018 |
| JP | 2019-164131 | A | 9/2019 |

OTHER PUBLICATIONS

European search report for EP 19 20 1389 dated Mar. 13, 2020.
Communication dated Aug. 4, 2021 by the China National Intellectual Property Administration in application No. 202011048269.9.
Notice of Reason for Refusal dated Sep. 14, 2021 from the Japanese Patent Office in JP application No. 2020-152557.

* cited by examiner

*Primary Examiner* — Sean Kayes
(74) *Attorney, Agent, or Firm* — Sughrue Mion, PLLC

(57) ABSTRACT

The invention relates to a spring ring 14 for snap fitting a rotating bezel, the spring ring extending in a plane and being intended to be received in an annular groove arranged on a cylindrical outer rim of a watch case middle part made of ceramic. According to the invention, the spring ring comprises on the inner rim thereof at least one lug inclined in relation to the plane of the spring ring, said lug being intended to engage with a cylindrical outer surface of the watch case middle part, so as to index the position of the spring ring in relation to the middle part.

8 Claims, 2 Drawing Sheets

SPRING RING FOR SNAP FITTING A ROTATING BEZEL

CROSS-REFERENCE TO RELATED APPLICATION

This application claims priority to European Patent Application No. 19201389.4 filed on Oct. 4, 2019, the entire contents of which are incorporated herein by reference.

TECHNICAL FIELD OF THE INVENTION

The invention relates to a spring ring for snap fitting a rotating bezel.

The invention also relates to a rotating bezel system comprising the spring ring.

The invention also relates to a watch case comprising a middle part made of ceramic and the rotating bezel system rotatably mounted on the middle part.

The invention further relates to a watch including the watch case.

PRIOR ART

Known rotating bezel systems are provided with a spring ring intended to engage with the rotating bezel in order to enable the snap fitting of said latter. Such a snap fitting subsequently enables a precise rotation of the rotating bezel about a watch case middle part for example. When the middle part is made of ceramic, said latter generally has a cylindrical outer rim provided with an annular groove intended to receive the spring ring. However, in this case, scratches caused by the machining of the middle part are present in the groove base. These scratches, which for example are visible in FIG. 2, are unavoidable because same are generated by the grinding machines used for machining the groove. Yet, a problem that arises in such systems with middle part made of ceramic is that, when the spring ring enters into contact with the scratch or the scratches present in the groove base, the spring ring is likely to no longer be positioned flat in the groove. This causes problems of torque variation, of the gap even of the mechanical fatigue between the parts, and therefore a premature wear of the rotating bezel system.

SUMMARY OF THE INVENTION

Therefore, the aim of the invention is to provide a spring ring for snap fitting a rotating bezel for guaranteeing a correct positioning of the spring ring in the groove base of a watch case middle part made of ceramic, and thus reduce the mechanical wear of the parts and therefore increase the reliability and durability of the assembly.

To this end, the invention relates to a spring ring for snap fitting the rotating bezel that comprises the features mentioned in independent claim 1.

Specific shapes of the spring ring are defined in dependent claims 2 to 6.

The presence of at least one inclined lug on the inner rim of the spring ring, which lug is intended to engage with a cylindrical outer surface of the watch case middle part, makes it possible to prevent the spring ring from being in contact with the scratch or the scratches present in the groove base. This makes it possible to index the position of the spring ring in relation to the middle part, and thus to guarantee a flat positioning of the spring ring in the groove provided on the middle part. The variation of the rotational torque of the bezel as well as the mechanical wear of the various parts are consequently reduced in relation to the systems of prior art. The reliability and the durability of the assembly comprising the spring ring are thus advantageously improved.

Furthermore, the spring ring according to the invention also has the advantage of being easy to manufacture and to install within a watch case middle part, of being interchangeable with various currently existing parts, of being easily replaceable during after-sales service, as well as of improving the sensory quality of the product as well as the user sensation, particularly with regards to the feeling of rotational precision of the rotating bezel.

Advantageously, the spring ring comprises three inclined lugs distributed on the inner rim thereof over 360°, the three inclined lugs being spaced apart two by two by 120°. This makes it possible to recentre the spring ring in relation to the watch case middle part, independently of the scratches present at the base of the groove, and thus to again improve the correct position of the spring ring in the groove. The mechanical wear of the parts is thereby equally reduced.

According to one specific technical feature of the invention, the spring ring further comprises at least one notching tab intended to engage with a rotating bezel for snap fitting said bezel on the spring ring.

To this end, the invention also relates to a rotating bezel system comprising the spring ring described above, and that comprises the features mentioned in dependent claim 7. The rotating bezel is typically an annular rotating bezel, preferably, a unidirectional bezel.

To this end, the invention also relates to a watch case comprising a middle part made of ceramic and the rotating bezel system, described above, and that comprises the features mentioned in dependent claim 8.

To this end, the invention also relates to a watch comprising the watch case described above, and that comprises the features mentioned in dependent claim 9.

BRIEF DESCRIPTION OF THE FIGURES

The aims, advantages and features of the spring ring for snap fitting a rotating bezel according to the invention will become clear in the following description based on at least one non-limiting embodiment illustrated by the drawings wherein.

DETAILED DESCRIPTION OF THE INVENTION

Figure 1:
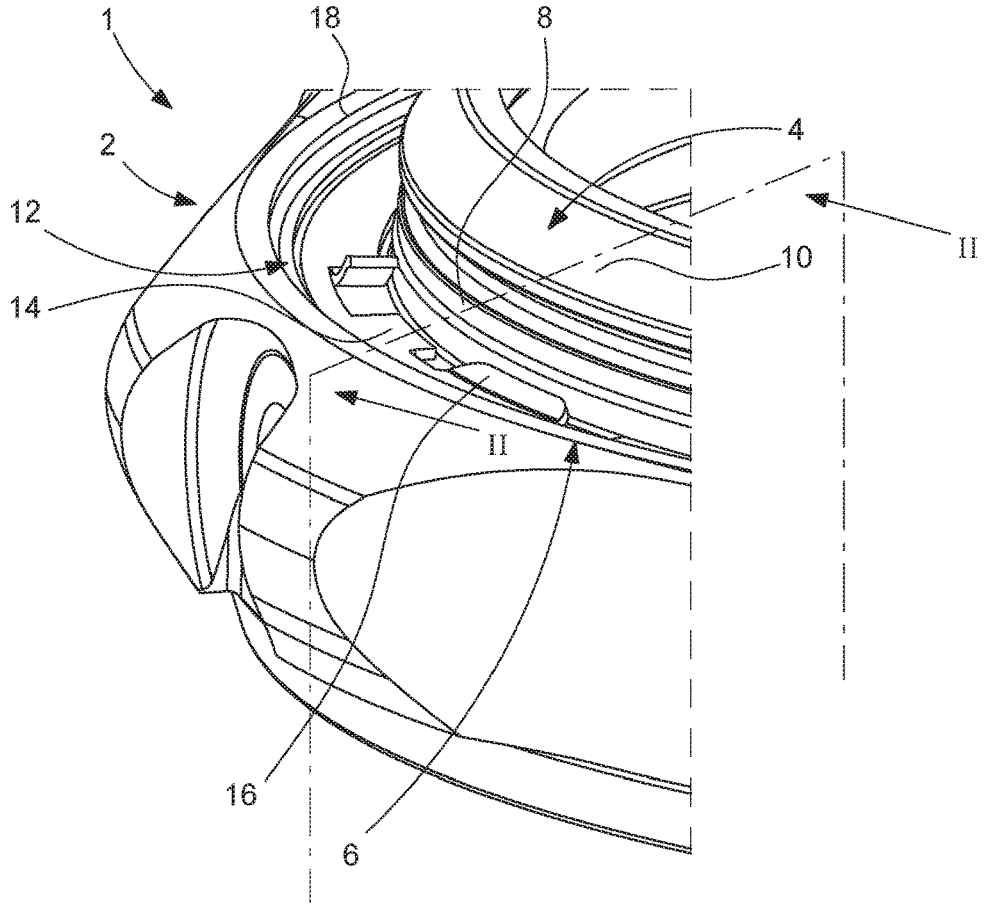
FIG. 1 is a perspective view of a watch case equipped with a rotating bezel system comprising a spring ring according to one embodiment of the invention.

FIG. 1 shows a watch 1 provided with a watch case 2. The watch case 2 typically comprises a middle part 4 made of ceramic. The watch case 2 also comprises a rotating bezel system 6 as well as a horological movement, the horological movement not being shown in the figures for reasons of clarity. The rotating bezel system 6 is rotatably mounted on the middle part 4. Preferably, the rotating bezel system 6 consists of an independent module.

Figure 2:
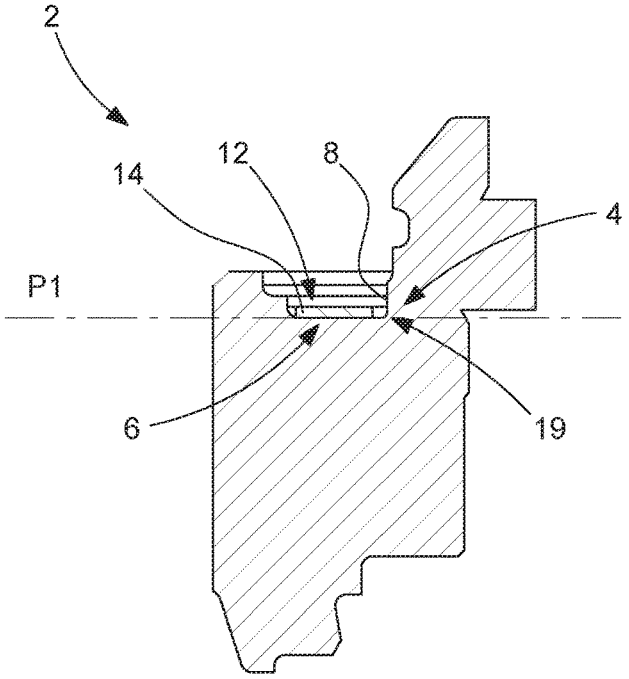
FIG. 2 is a sectional view of the watch case of FIG. 1, taken according to a sectional plane II-II.

As illustrated in FIG. 1, the middle part 4 is of annular shape. The middle part 4 comprises a cylindrical outer surface 8 that delimits a portion 10 of the middle part 4 known as body. The middle part 4 is further provided, on the cylindrical outer rim, with an annular groove 12. As illustrated in FIGS. 1 and 2, the annular groove 12 is intended to receive the spring ring 14 according to the invention, as will be subsequently described.

The rotating bezel system 6 comprises a rotating bezel and a spring ring 14 for snap fitting the rotating bezel. The rotating bezel, which is typically an annular rotating bezel, preferably a unidirectional bezel, is not visible in the figures for reasons of clarity. The rotating bezel is held by a section spring that moves apart during the passage of the bezel on the body of the middle part in order to subsequently be inserted into the middle part groove and engage with the spring ring 14 by snap fitting. The spring ring 14 is received in the annular groove 12 and extends in a plane P1 illustrated in FIG. 2, which plane P1 is substantially horizontal when the spring ring 14 is disposed in the groove 12.

The spring ring 14 comprises on the inner rim thereof at least one lug 16 inclined in relation to the plane P1. In the embodiment illustrated in FIGS. 1 to 3, the spring ring 14 comprises three inclined lugs 16 distributed on the inner rim thereof over 360° and spaced apart two by two by 120°. Preferably, the spring ring 14 further comprises at least one notching tab 18 intended to engage with the rotating bezel for snap fitting the bezel on the spring ring 14. In the embodiment illustrated in FIGS. 1 to 3, the spring ring 14 comprises three notching tabs 18 distributed over 360° and spaced apart two by two by 120°. The spring ring 14 consists of a single material part. The spring ring 14 is for example made of a material such as Phynox.

As seen in FIG. 1, each inclined lug 16 engages with the cylindrical outer surface 8 of the middle part 4, so as to index the position of the spring ring 14 in relation to the middle part 4. In this way, the spring ring 14 is always indeed positioned flat in the annular groove 12. In particular, as illustrated in FIG. 2, the spring ring 14 never enters into contact with the scratch 19 present at the base of the groove 12, which makes it possible to prevent the problems of wear and of torque variation. In the specific embodiment in FIGS. 1 and 2, said scratch 19 has a width substantially equal to 0.2 mm.

Figure 3:
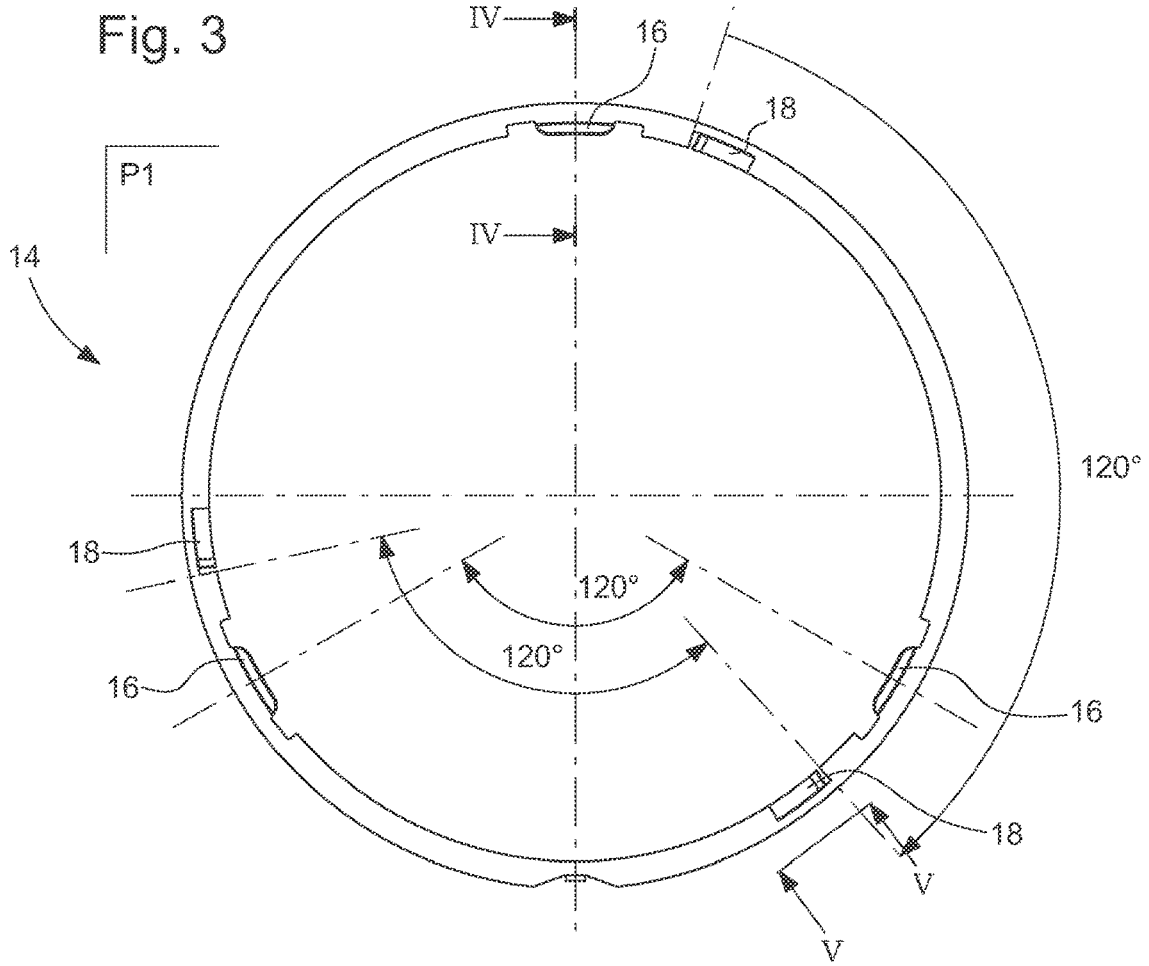
FIG. 3 is a top view of the spring ring of FIG. 1.
Figure 4:
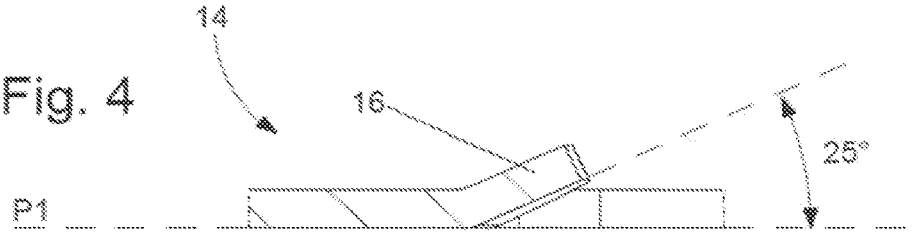
FIG. 4 is a sectional view of the spring ring of FIG. 3, taken according to a sectional plane IV-IV.

Preferably, as illustrated in FIGS. 1, 3 and 4, each lug 16 extends towards the centre 20 of the spring ring 14, and is inclined upwardly in relation to the plane P1. In the specific embodiment in FIGS. 1 and 4, each lug 16 is inclined in relation to the plane P1 at an angle substantially equal to 25°.

Figure 5:
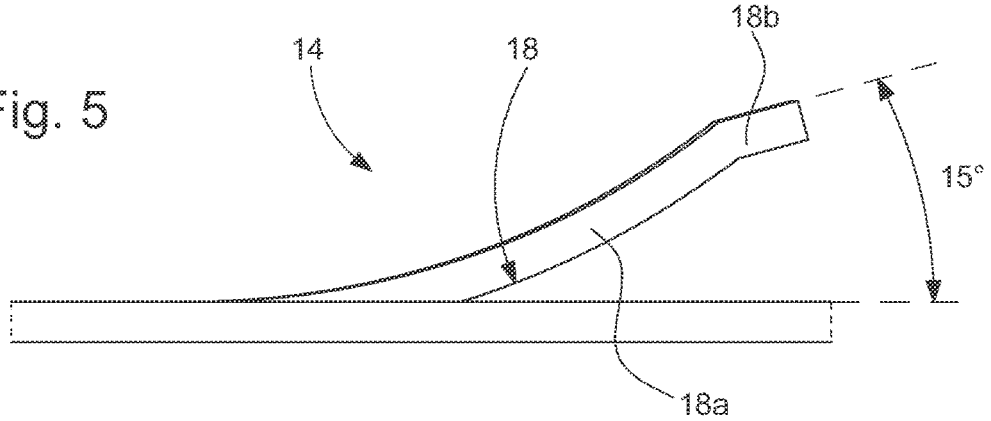
FIG. 5 is a sectional view of the spring ring of FIG. 3, taken according to a sectional plane V-V.

Each notching tab 18 is configured to engage either with same rotating bezel, or with a part attached on the bezel, so as to snap fit the bezel on the spring ring 14. For this, as illustrated in FIG. 5, each notching tab 18 comprises for example a first portion 18*a* and a second portion 18*b* both extending upwardly in relation to the plane P1. The first portion 18*a* has for example an arched shape whereof the curve tends to move same away from the plane P1, the centre of the osculating circle taken in any point of the first portion 18*a* being located opposite the plane P1 in relation to the tab 18. The second portion 18*b* is for example a flat portion, inclined in relation to the plane P1. In the specific embodiment in FIG. 5, the second portion 18*b* of each notching tab 18 is inclined in relation to the plane P1 at an angle substantially equal to 15°. Preferably, as illustrated in FIG. 1, each notching tab 18 is formed via a cut made beforehand in the thickness of the spring ring 14. The shape of the cut is thus complementary of the shape of the corresponding tab 18.

The invention claimed is:

1. A spring ring (14) for snap fitting a rotating bezel, the spring ring (14) extending in a plane (P1) and being configured to be received in an annular groove (12) arranged on a cylindrical outer rim of a watch case (2) middle part (4) made of ceramic;

wherein the spring ring (14) comprises on the inner rim thereof at least one lug (16) inclined outwards from the annular groove (12), towards a centre axis of the spring ring (14), and in relation to the plane (P1) of the spring ring (14), the centre axis being orthogonal to the plane (P1) and passing through a centre of the spring ring, said lug (16) being configured to engage with a cylindrical outer surface (8) of the watch case (2) middle part (4), so as to index the position of the spring ring (14) in relation to the middle part (4).

2. The spring ring (14) according to claim 1, wherein the at least one lug (16) is inclined in relation to the plane (P1) wherein extends the spring ring (14) at an angle substantially equal to 25°.

3. The spring ring (14) according to claim 1, wherein the spring ring (14) comprises three inclined lugs (16) distributed on the inner rim thereof over 360° and spaced apart by 120°.

4. The spring ring (14) according to claim 1, wherein the spring ring (14) further comprises at least one notching tab (18) configured to engage with a rotating bezel for snap fitting said bezel on the spring ring (14).

5. The spring ring (14) according to claim 4, wherein the spring ring (14) comprises three notching tabs (18) distributed on the ring (14) over 360° and spaced apart by 120°.

6. A rotating bezel system configured to be rotatably mounted on a watch case (2) middle part (4) made of ceramic within which is housed a horological movement, the system (6) comprising a rotating bezel and a spring ring (14) for snap fitting the rotating bezel, wherein the spring ring (14) is in accordance with claim 1.

7. A watch case (2) comprising a middle part (4) made of ceramic and a system (6) provided with a rotating bezel rotatably mounted on the middle part (4), the middle part (4) having a cylindrical outer rim provided with an annular groove (12), wherein the rotating bezel system (6) is in accordance with claim 6, the spring ring (14) being received in the annular groove (12) provided on the middle part (4), the at least one inclined lug (16) engaging with a cylindrical outer surface (8) of the middle part (4).

8. A watch including a watch case (2) in accordance with claim 7.

* * * * *